US005218796A

United States Patent [19]

McCullough et al.

[11] Patent Number: 5,218,796

[45] Date of Patent: Jun. 15, 1993

[54] STRUCTURAL SUPPORT SYSTEM

[75] Inventors: George S. McCullough, Schenectady; Brian D. Cull, Rotterdam, both of N.Y.

[73] Assignee: General Electric Company, Schenectady, N.Y.

[21] Appl. No.: 792,522

[22] Filed: Nov. 15, 1991

[51] Int. Cl.[5] ..... E04B 9/00

[52] U.S. Cl. ..... 52/126.5

[58] Field of Search ..... 52/185, 187, 126.1, 52/126.5; 182/115, 149; 248/242, 291, 354.1; 211/189, 191

[56] References Cited

U.S. PATENT DOCUMENTS

| | | | |
|---|---|---|---|
| 1,486,444 | 3/1924 | Malmgren . | |
| 1,734,170 | 11/1929 | Leffert . | |
| 2,195,579 | 4/1940 | Murdock | 248/242 |
| 2,624,468 | 1/1953 | McCauley | 211/123 |
| 2,907,598 | 10/1959 | Hart | 287/58 |
| 3,175,654 | 3/1965 | Calvert | 189/43 |
| 3,385,400 | 5/1968 | Whitsett | 182/150 |
| 3,480,247 | 11/1969 | Waner | 248/355 |
| 3,550,723 | 12/1970 | Gentry | 182/36 |
| 3,765,666 | 10/1973 | Chretiennot | 269/37 |
| 3,788,018 | 1/1974 | Simmons et al. | 52/185 |
| 3,927,518 | 12/1975 | Simmons et al. | 52/183 |
| 4,953,666 | 9/1990 | Ridings | 187/9 R |

*Primary Examiner*—Carl D. Friedman
*Assistant Examiner*—Creighton Smith
*Attorney, Agent, or Firm*—Nixon & Vanderhye

[57] ABSTRACT

An elevated walkway support system comprising a plurality of horizontal support members supporting said walkway above a foundation, the horizontal support members adapted for attachment at first ends thereof to one or more associated supports; and a plurality of adjustable length braces extending between second ends of respective ones of the horizontal support members and the foundation at a location closer to the first ends than the second ends in a horizontal direction.

20 Claims, 2 Drawing Sheets

STRUCTURAL SUPPORT SYSTEM

BACKGROUND AND SUMMARY OF THE INVENTION

This invention relates to an adaptable and adjustable structural support system for use in walkway and/or stairway constructions, with or without associated external piping supports.

In present plant construction practice, walkways, stairways and external piping supports are separately designed and installed to meet specific plant requirements, in further combination with associated piers and/or foundations utilized to support base components of the walkways and stairways.

The present invention seeks to eliminate the need for the special design, manufacture, shipping and installation of separate support systems for walkways, stairways, external piping and the like. The present invention also reduces the number of piers and/or foundations typically required to support such structures. The present invention also eliminates the current problem of interference between independent walkways and nearby piping supports. Piping supports are brackets or hangers used to support pipes of all kinds, extending generally along a walkway.

Thus, it is the principal object of this invention to provide a low-cost, manufacturing/installation-efficient system which integrates walkway and/or stairway supports and including piping supports where appropriate, and which provides flexibility by allowing adjustment for otherwise unpredictable variations in the main unit or plant foundation.

To this end, and in accordance with one embodiment of the invention, a telescoping, pivotally mountable brace is provided which may be used with the main centerline foundation to augment unit mounted, cantilevered supports. An easily mountable extension for the cantilevered supports is also provided for use as a piping support.

More specifically, in a first exemplary embodiment the present invention provides a structural support system for a horizontally oriented walkway extending in a longitudinal direction and otherwise supported by a plurality of transversely extending supports, axially spaced along the length of the walkway. Such walkways are typically elevated relative to a factory/plant floor or foundation and, of course, it will be appreciated that the height above the floor of foundation can vary almost infinitely between different plants. In accordance with this first exemplary embodiment of the invention, an essentially universal support brace is provided which is adapted to extend between a foundation support at one end and a transverse walkway support at the other. Specifically, the support brace comprises a pair of telescoping tubular members which may be pivotally secured at either end to brackets secured to the foundation and the transverse walkway support. This arrangement allows the tubular support brace to accommodate any number of dimensional changes relating to the height of the walkway above a foundation or floor (within, of course, limits determined by the expanded length of the tubular support). After installation, the interface between the tubular members as well as the pivotal mounting at either end of the brace may be welded to increase the overall rigidity and strength of the support while precluding any axial or pivotal movement of the brace relative to the foundation and/or the transverse walkway supports.

In this first exemplary embodiment, extensions may be provided for any appropriate number of the transverse walkway supports for mounting external piping support hangers which enable the piping to extend along but below the walkway so that the piping is easily accessible but does not interfere with the walkway and/or any of the supports or support braces utilized in conjunction therewith.

In a second exemplary embodiment of the invention, the above described support brace is utilized at a location where a stairway is provided for reaching the walkway from the ground or foundation level. In this instance, a triangular support arrangement is created by means of one tubular support brace extending from the foundation to one end of the transverse walkway support; the stairway stringer plate which extends from the upper end of the support brace and same end of the transverse walkway support to the foundation; and a second tubular support brace (similar to the first, but with a greater length) extending horizontally between the bottom end of the first support brace and the bottom end of the stairway stringer. Since the first and second support braces are adjustable in length, they may be advantageously utilized in any number of situations where walkways and stairways are combined, and as already noted, will accommodate walkways located at different heights above the foundation which not only determines the length requirement of the first brace, but which will also bear on the length requirement for the second, horizontal support brace.

Thus, the present invention provides simple, low cost support structures which are adaptable to any number of walkway and/or walkway/stairway arrangements, eliminating the need for custom designed support structures otherwise necessary for each application.

Other objects and advantages of the present invention will become apparent from the detailed description which follows.

DETAILED DESCRIPTION OF THE DRAWINGS

Figure 1:
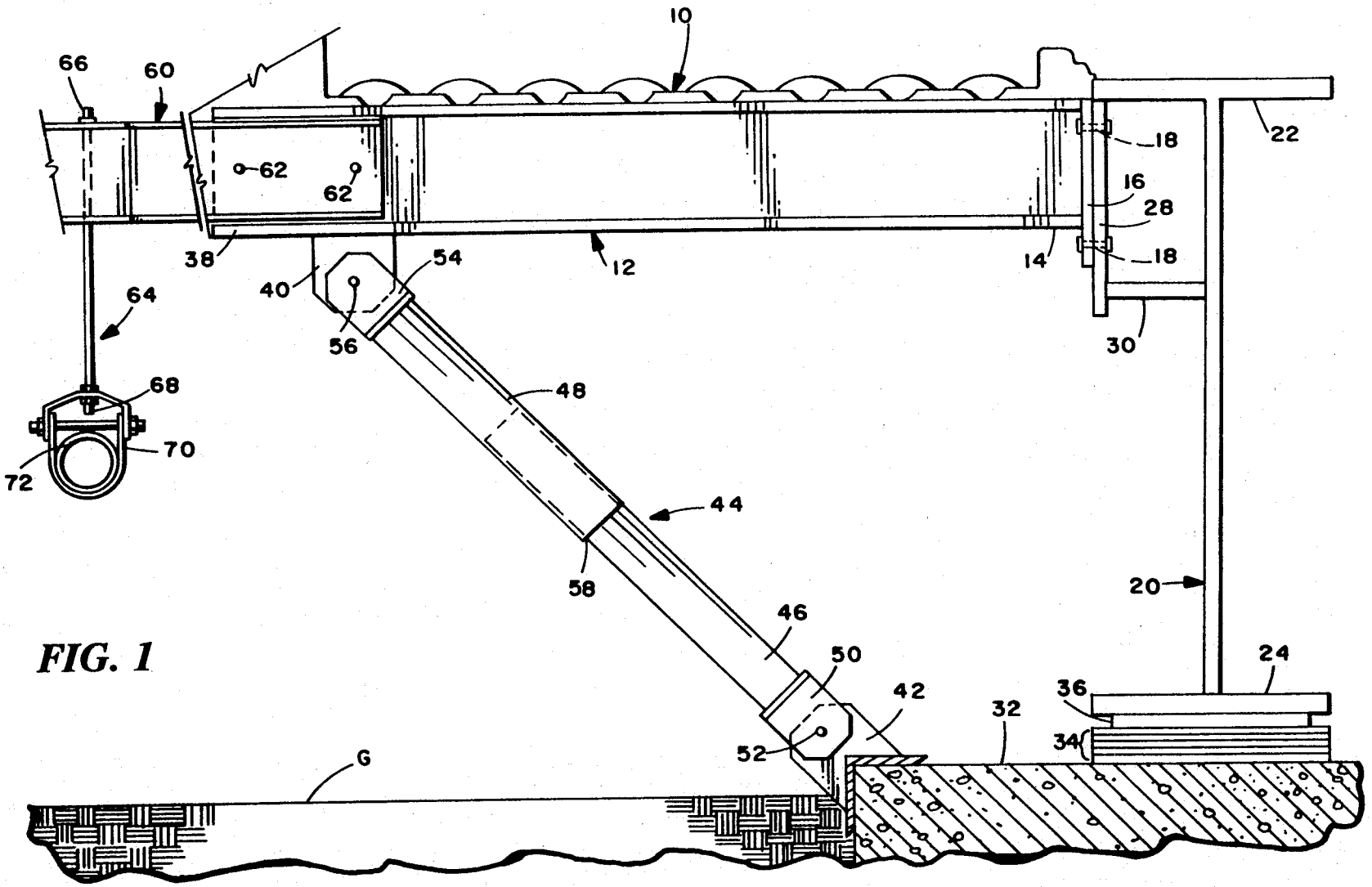
FIG. 1 is a partial side view of a structural support system in accordance with the invention, used in conjunction with a walkway.

With reference now to FIG. 1, an elevated structural support system in accordance with one embodiment of this invention includes a substantially horizontal walkway 10 extending in a longitudinal direction, i.e., into the paper, supported above the ground G by a plurality of transversely extending I-beams or supports 12, only one of which is shown and only one of which will be described herein. The support 12 is secured at its inner end 14 by means of a plate 16 and suitable fasteners 18 (or other suitable fastening means) to an upstanding I-beam 20 having upper and lower cross plates 22, 24. Specifically, the plate 16 is secured to a plate 28 which, along with a horizontal plate 30, forms a box-like structure in conjunction with the upper web 22 of the I-beam 20, thereby enabling the support 12 to be securely fastened in a substantially horizontal orientation. As shown in FIG. 1, plate 30 is fastened between the web portion of the I-beam 20 and the plate 28, while plate 28 is fastened between the plate 30 and the cross-plate 22 of the I-beam. This may be accomplished by welding or other suitable means.

The lower plate 24 of the I-beam 20 is supported on a concrete base or foundation 32 by means of one or more shims 34, and a pad 36 which serve to adjust the height of the beam 20 as required.

The outer end 38 of the support 12 is provided with a downwardly extending bracket 40 while the base 32 is provided with a somewhat similar bracket 42. Extending between brackets 40 and 42 is an adjustable support brace 44 which includes a pair of telescoping, tubular members 46, 48. The distal end of the smaller diameter tubular member 46 is provided with a mounting element 50 which is adapted for pivotal securement to the bracket 42 by means of a pin 52. Similarly, the larger diameter tubular member 48 is provided with a mounting element 54 by which the tubular member 48 is pivotally secured to the bracket 40 by means of a pin 56.

As a result of the above described arrangement, the walkway 10 is adequately supported by a triangular arrangement including the cantilevered supports 12, I-beam 20 and a plurality of braces 44 axially spaced along the longitudinal direction of the walkway. Moreover, because of the pivot type connection at either end of the brace as well as the telescoping relationship between the components 46, 48 of the brace, and within the limits of the compressed and extended lengths of the brace, the latter may be employed to support walkways at different heights as measured from the ground G (or concrete base or foundation 32), and of different widths as measured by the length of the cantilevered supports 12. As a result, a single brace construction may be utilized as part of a support system for many different walkways, thereby substantially eliminating the need for customized design of supports to fit specific dimensions.

Once in place, the overall rigidity and strength of the support system can be enhanced by welding the interconnections between brackets 40, 54, and 50, 42 to preclude any relative movement therebetween. At the same time, a further weld at the interface of the telescoping members 46, 48 and shown at 58 will further improve the overall strength and rigidity of the system.

As a further feature of the invention, a lateral extension 60 in the form of a steel plate, beam construction, or the like, may be secured to the outer end 38 of the support 12 by any suitable means such as bolts or rivets (shown generally at 62) which facilitates the incorporation of a piping support 64 into the walkway structural support system. More specifically, the hanger 64 which may be in the form of a partially threaded rod fixed at one end 66 to the extension 60, extends downwardly to a terminal end portion 68 which secures a piping support bracket 70 for supporting a pipe or conduit 72 which may run substantially parallel to, and along the length of, the walkway 10 as shown in FIG. 1. This arrangement provides for convenient access to the piping while nevertheless locating the piping sufficiently away from, i.e., below, the walkway 10 and its structural support system to preclude any interference therebetween.

Figure 2:
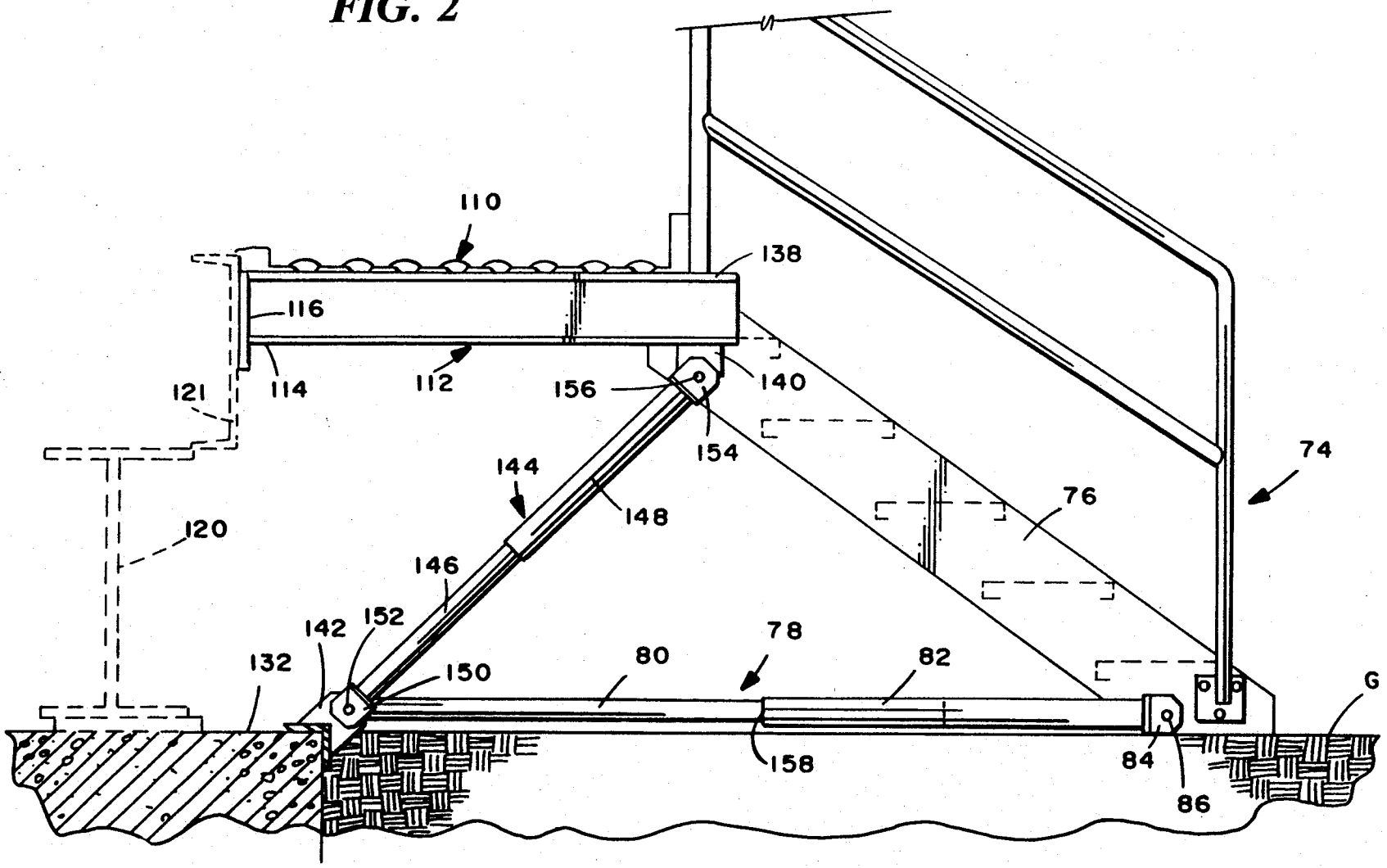
FIG. 2 is a partial side view of a structural support system in accordance with the invention, used in conjunction with a walkway and a stairway.

Turning now to FIG. 2, a variation of the above described support system is illustrated which incorporates a modular stairway unit 74. As will be immediately recognized, a number of components are similar to those illustrated in FIG. 1 and, for convenience, similar reference numerals are utilized to designate similar components but with the prefix 1 added. Thus, the longitudinally extending walkway 110 is supported by a plurality of cantilevered support beams 112 fastened at their inner ends 114 to plates 116 which are, in turn, at least indirectly connected to a support such as I-beam 120 (via additional beam 121).

The outer end 138 of the beam 112 is provided with a depending bracket 140 while the concrete base or foundation 132 is provided with a similar bracket 142. An adjustable support brace 144 extends between the brackets 140 and 142 and includes telescoping components 146, 148. The distal ends of the components 146, 148 are provided with mounting brackets 150, 154, respectively, which are pivotally secured to the brackets 140, 142 by means of pivot pins 152, 156.

In this embodiment, however, a stairway 74 is rigidly secured between the walkway support system and the ground in the manner described below.

The stair stringer plate 76 (one of two shown) extends between the ground G and the cantilevered or transverse support members 112 at an angle of, for example, 30°–40°. At the same time, a second adjustable support brace 78 including telescoping components 80, 82 extends horizontally, i.e., substantially parallel with the ground G, between the mounting bracket 142 (by means of a mounting bracket and pin, not shown, but similar to bracket 150 and pin 152) on the concrete base 132 and the lowermost end of the riser 76, by means of mounting bracket 84 and pivot pin 86. Welding of the joints is again carried out after installation. In this way, a triangular support system is established comprising the stair stringer 76, the first adjustable brace 78 and the second adjustable brace 144.

It will be appreciated that a similar triangular support arrangement for a stairway/walkway may be achieved using similar tubular members 78 and 144 even though the number of stairs in the stairway and/or the slope of the stairway (by reason, e.g., of a different height of the walkway above the ground) changes. This is due to the inherent adjustability and adaptability of the support braces 78 and 144. In other words, since these support braces are adjustable not only in length but also terms of a desired support angle relative to horizontal ground, the described system has great flexibility and adaptability while at the same time eliminating the need for otherwise custom designed support, braces, foundations, piers and the like.

While not shown, it will be appreciated that a piping support structure of the type illustrated in FIG. 1 may also be utilized in conjunction with the arrangement shown in FIG. 2, with suitable adaptations to accommodate the stairway 74.

In exemplary embodiments, the adjustable, tubular support braces may be provided in, for example, lengths adjustable from about 18 inches to 72 or more inches. At the same time, the larger diameter of the two adjustable tubular members may have an outside diameter of about 2½ inches and an inside diameter of about 2 inches. Of course, other lengths and diameters may be used, depending on requirements.

From the above description, it will be appreciated that a complete walkway and/or walkway/stairway system may be installed within a plant, with or without external piping supports, utilizing far fewer support components and those which are normally required, by employing adjustable support braces which may be of a standardized construction.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An elevated walkway support system comprising:

a plurality of horizontal support members having first and second ends supporting said elevated walkway above a foundation. said horizontal support members attached at first ends thereof to one or more associated supports, said associated supports comprising stairway stringers, and wherein said horizontal supports are attached to upper ends of said stairway stringers; and a plurality of adjustable length braces extending between second ends of respective ones of said horizontal support members and said foundation, said braces engaging said foundation at a location closer to said first ends than said second ends in a horizontal direction.

2. The support system of claim 1 wherein each of said adjustable length braces is pivotally secured at said first and second ends to one of said horizontal support members and to said foundation, respectively.

3. The support system of claim 1 wherein said adjustable length braces comprise telescoping tubular members.

4. The support system of claim 1 wherein selected ones of said horizontal support members include extensions protruding horizontally beyond said walkway for supporting piping running substantially parallel to and below said walkway.

5. The support system of claim 1 and further comprising a plurality of additional adjustable length braces extending between lower ends of said stairway stringers and said second ends of said adjustable length braces.

6. The support system of claim 1 wherein selected ones of said horizontal support members include extension protruding horizontally beyond said walkway for supporting piping running substantially parallel to and below said walkway.

7. The support system of claim 5 wherein selected ones of said horizontal support members include extensions protruding horizontally beyond said walkway for supporting piping running substantially parallel to and below said walkway.

8. The support system of claim 1 wherein said adjustable length braces are pivotally secured at said first and second ends to said horizontal support members and said foundation, respectively.

9. The support system of claim 5 wherein said adjustable length braces are pivotally secured at said first and second ends to said horizontal support members and said foundation, respectively.

10. The support system of claim 3 or 4 wherein all interfaces between said telescoping tubular members are welded after installation.

11. An elevated walkway and associated stairway support system comprising:

a plurality of horizontal support members supporting the walkway above ground and above a foundation, each of said horizontal support members attached at a first end to one or more associated supports;

said stairway extending between the ground and second ends of said horizontal support members;

at least one adjustable length brace extending between said second end of at least one of said horizontal support members and a foundation substantially vertically beneath said first ends; and at least one additional adjustable length brace extending between said stairway and said foundation, substantially parallel to the ground to thereby establish a triangular support defined by said stairway, said one and said another adjustable length braces.

12. The support system of claim 11 wherein said adjustable length braces are pivotally secured at said first and second ends to said horizontal support members and said foundation, respectively.

13. The support system of claim 11 wherein said at least one adjustable length brace and said at least one additional adjustable length brace comprise telescoping tubular members.

14. The support system of claim 11 wherein selected ones of said horizontal support members include extensions protruding horizontally beyond said walkway for supporting piping running substantially parallel to and below said walkway.

15. The support system of claim 11 wherein said associated supports comprise substantially vertical members rising from said foundation.

16. The support system of claim 11 wherein selected ones of said horizontal support members include extensions protruding horizontally beyond said walkway for supporting piping running substantially parallel to and below said walkway.

17. The support system of claim 12 wherein said additional adjustable length braces are pivotally secured between said stairway and said foundation.

18. The support system of claims 2 or 12 wherein each of said adjustable length braces is welded at said first and second ends to said horizontal support members and said foundation, respectively, after installation.

19. The support system of claim 17 wherein said additional adjustable length braces are welded between said stairway and said foundation after installation.

20. An elevated walkway support system comprising:

a plurality of horizontal support members having first and second ends supporting said elevated walkway above a foundation, said horizontal support members attached at first ends thereof to one or more associated supports, wherein said associated supports comprise substantially vertical members rising from said foundation; and a plurality of adjustable length braces extending between second ends of respective ones of said horizontal support members and said foundation, said braces engaging said foundation at a location closer to said first ends than said second ends in a horizontal direction.

* * * * *